United States Patent [19]

Brocklehurst

[11] 4,227,684

[45] Oct. 14, 1980

[54] SHEET FOLDER

[75] Inventor: Charles E. Brocklehurst, Fountain Inn, S.C.

[73] Assignee: Opelika Manufacturing Corp., Chicago, Ill.

[21] Appl. No.: 954,935

[22] Filed: Oct. 26, 1978

[51] Int. Cl.[3] ..... B65H 45/18

[52] U.S. Cl. ..... 270/67; 270/79

[58] Field of Search ..... 270/79, 67; 38/143; 242/74.1

[56] References Cited

U.S. PATENT DOCUMENTS

| | | | |
|---|---|---|---|
| 1,203,722 | 11/1916 | Fulk | 270/79 |
| 3,495,819 | 2/1970 | Davidson | 270/79 |
| 3,711,086 | 1/1973 | Weist | 270/69 |
| 3,729,846 | 5/1973 | Weir | 38/143 |

*Primary Examiner*—Edgar S. Burr
*Assistant Examiner*—A. Heinz
*Attorney, Agent, or Firm*—Jones, Thomas & Askew

[57] ABSTRACT

Bed sheets are moved in an unfolded condition along their lengths on a horizontal conveyor, grasped at the opposite sides of their leading edge, stretched at their leading edge and fed into a nip roll of a folder. The nip roll progressively moves the sheet down an inclined guide plate toward a first clamp assembly. The first clamp assembly holds the leading edge of the sheet, and the sheet is spread away from the first clamp assembly into a second, facing clamp assembly. The second clamp assembly grasps the sheet and the first clamp assembly releases the sheet, and the sheet is spread away from the second clamp assembly toward the first clamp assembly, the first clamp assembly regrasps the sheet as the second clamp assembly releases the sheet, and the progressive, alternative spreading and clamping functions continue to draw the sheet into the clamp assemblies and fold the sheet in an accordion fold. The sheet is then conveyed along its folded length out the ends of the two clamp assemblies to a winding fork where the according folded sheet is grasped by and folded about the winding fork in a flat spiral configuration and then is moved off the ends of the tines of the winding fork.

14 Claims, 17 Drawing Figures

SHEET FOLDER

DESCRIPTION

TECHNICAL FIELD

This invention relates to a method and apparatus for forming bed sheets and the like first in an accordion folded configuration and then in an approximately flat spiral folded configuration for packaging and merchandizing.

BACKGROUND OF THE INVENTION

Bed sheets and similar mass produced items such as bedspreads, curtains and table cloths are usually folded into an attractive, dense package, with the label of the product exposed for inspection by the potential customer. Sometimes the sheet is wrapped in a transparent package. Because the sheets, etc. are manufactured in different sizes, it is desirable to fold the different size sheets in different ways so that the packages formed by the sheets are approximately the same length and width, regardless of the size of the sheet. This means that a smaller sheet will have fewer folds than a larger sheet. For example, a sheet for a "single" bed is narrower than a sheet for a larger "twin", "queen" or "king" size bed, and while the single size sheet may have as many folds across its length as the other size sheets, it is likely to have fewer folds across its width.

Various techniques have been developed for folding sheets, including various hand and automatic techniques. For example, a sheet may be folded across its length, then across its width, and again across its length, or a sheet may be folded several times across its width to form an elongated shape, and then folded several times across its length. In some instances, particularly when automated folding equipment is utilized, a sheet may be wound in a tube, the tube flattened, and then the flattened tube folded across its length.

Hand folding of sheets and the like is cumbersome and slow because of the large expanse of material that must be handled by the workers. While various automated folding apparatus has been developed for folding sheets and the like, they are large and require a substantial amount of floor space, the apparatus is expensive, and in some instances, the operation of the apparatus is slow and requires a substantial amount of operator time.

SUMMARY OF THE INVENTION

Briefly described, the present invention comprises a sheet folding method and apparatus wherein a bed sheet or similar flat article is processed through a series of steps, first into a pleated or flat accordion folded configuration, and next the sheet in its flat accordion folded configuration is wound into a substantially flat spiral package. The system is constructed so that the sheet can be taken from a horizontal conveyor line where its edges have been hemmed, the leading edge of the sheet grasped and stretched into a substantially flat configuration, and the flat leading edge passed to a nip roll which feeds the sheet down an inclined guide plate. The leading edge of the sheet is grasped by a first elongated clamp assembly, the nip roll terminates its function, and the sheet is then spread away from the first clamp assembly into a facing second clamp assembly. The sheet is held by the second clamp assembly while the first clamp assembly releases the sheet, and then the sheet is spread in the opposite direction away from the second clamp assembly back toward the first clamp assembly, whereupon the first clamp assembly re-engages the sheet and the second clamp assembly releases the sheet. The clamping and spreading steps are repeated until the entire length of the sheet is drawn into the clamps, whereupon the sheet is formed in a pleated or flat accordion folded configuration. The sheet is then moved along the length of the clamps and into the tines of a winding fork positioned at one end of the clamps. The winding fork rotates and winds the accordion folded sheet onto its tines in a substantially flat spiral configuration. The sheet is then pulled off the ends of the tines of the winding fork and is ready for wrapping and shipment to the retail merchant, etc.

The sheet folder apparatus includes a pair of spreader plates that oscillate in unison, with the first spreader plate positioned over the first elongated clamp assembly and movable into and out of the opposite facing elongated clamp assembly, and the second spreader plate positioned over the second elongated clamp assembly and movable into and out of the first facing elongated clamp assembly. The sheet is guided from above the spreader plates down into the clamps, and each spreader plate moves into the plane of the sheet and spreads the sheet over to the opposite clamp assembly, where the clamp assembly grasps and holds the sheet while permitting the spreader plate to be withdrawn from the clamp assembly. This back and forth motion of the spreader plates into and out of the clamp assemblies forms the sheet in an accordion folded or zig-zag pleated configuration.

Thus, it is an object of this invention to provide a sheet folder system which forms bed sheets and similar articles in a neat accordion folded configuration.

Another object of this invention is to provide a sheet folder system which expediently and reliably folds bed sheets and similar articles first in an accordion folded configuration and then winds the accordion folded sheet into a substantially flat spiral folded configuration.

Another object of this invention is to provide apparatus for folding sheets and similar items, said apparatus being constructed in a compact configuration so as to occupy a minimum of work space.

Other objects, features and advantages of the present invention will become apparent upon reading the following specification, when taken in conjunction with the accompanying drawings.

DETAILED DESCRIPTION

Figure 1:
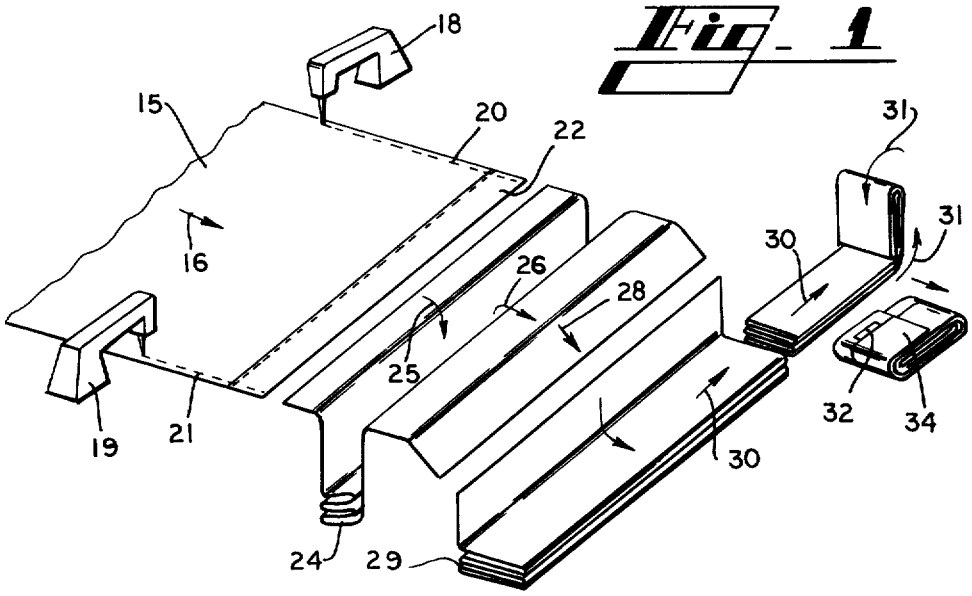
FIG. 1 is a schematic illustration of the method of feeding and folding sheets.

Referring now in more detail to the drawings, in which like numerals indicate like parts throughout the several views, FIG. 1 illustrates the manner in which a bed sheet 15 or a similar flat item is folded, wherein the bed sheet moves in the direction indicated by arrow 16, for example through sewing machines 18 and 19 which hem the opposite side edges 20 and 21. The leading edge 22 was previously hemmed in another stage (not shown) of the system. The side edges 20 and 21 of the sheet 15 are grasped at a positions adjacent the leading edge 22 as the sheet 15 moves off the horizontal conveyor (not shown), the leading edge of the sheet is stretched and then moved into the sheet folder. The movement of the leading edge of the sheet is delayed momentarily so as to permit the following portion of the sheet 15 to accumulate at 24, by moving under the influence of gravity as indicated by arrow 25 to a lower level. The leading edge of the sheet is then fed as indicated by arrow 26 on into the accordion folding assembly. The sheet moves down an incline 28, is folded into an accordion folded configuration or Z-shaped configuration, and the sheet then is moved along its folded length as indicated by arrow 30 to a winding fork which winds the accordion folded sheet into a substantially flat, spiral configuration, by rotating the sheet as indicated by arrows 31 on the winding fork. The label 32 and head hem 34 becomes located on the outer surface of the folded sheet so that they can be inspected by the ultimate customer, etc.

Figure 2:
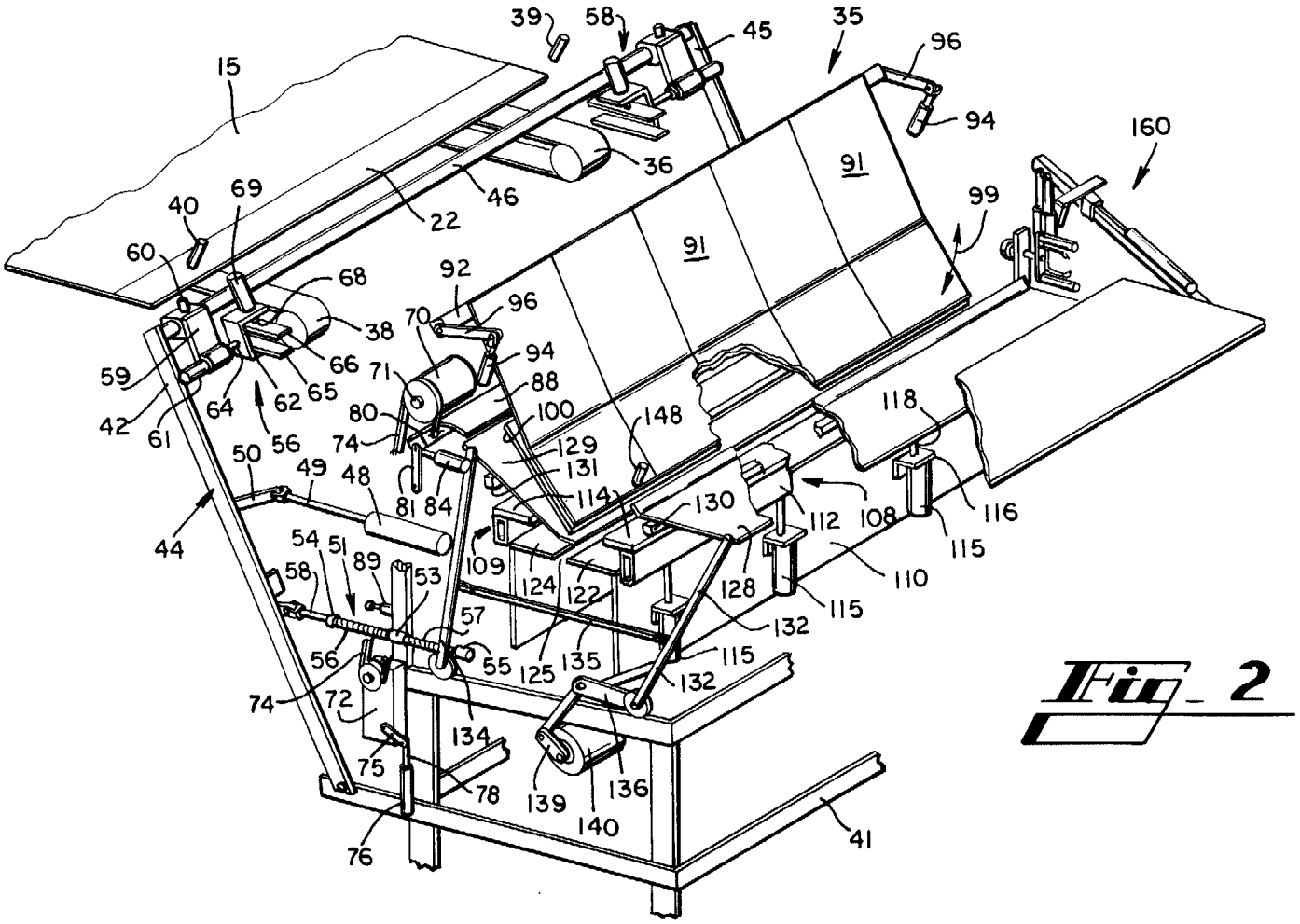
FIG. 2 is a schematic perspective illustration of the sheet folder.

As illustrated in FIG. 2, the sheet folder 35 is located at the end of a horizontal conveyor as represented by the conveyor tapes 36 and 38. A photocell 39 and 40 is located at each side edge portion of the path through which the sheet 15 travels on the horizontal conveyor so as to detect the presence of the oncoming leading edge 22 of the sheet.

Sheet folder 35 includes stationary support frame 41 (only partially illustrated in the drawings) that supports its various operational elements, and movable support frame 42 that is pivotally connected at its lower end to the stationary support frame 41. The movable support frame includes side legs 44 and 45 and cross bar 46. A pneumatic cylinder 48 is supported at each end of the stationary support frame 41 and the cylinder rods 49 of the cylinders 48 are connected to an extension 50 on each side leg 44 and 45 of the movable support frame, so as to swing the cross bar 46 from the end of the conveyor over to the sheet folder 35. A spring assembly 51 is also mounted at each end of stationary support frame 41, and each spring assembly 51 includes a rod 52 pivotally attached at one of its ends to a side leg of the movable support frame 42 and slidable through a collar 53 of the stationary support frame. Collars 54 and 55 are attached to rod 52, and coil compression springs 56 and 57 are positioned between collars 54 and 53 and between collars 55 and 53, thereby biasing the rod 52 and movable support frame 42 to a intermediate position between the conveyor and the sheet folder 35. Thus, cylinder 48 must positively urge the movable support frame 42 either toward the conveyor or toward the sheet folder while the springs 56 and 57 tend to bias the movable support frame to an intermediate position.

The cross bar 46 of the movable support frame 42 supports a pair of finger clamp assemblies 56 and 58. Each finger clamp assembly includes a mounting bracket 59 connected to cross bar 46, the mounting bracket 59 including means such as set screw 60 for permitting the mounting bracket to be moved to different positions along the length of the cross bar 46. Pneumatic cylinder 61 is held by mounting bracket 59, and C-shaped bracket 62 is supported by and is movable with the cylinder rod 64. A pair of grasping fingers 65 and 66 are supported in each C-shaped bracket 62, with the lower finger 65 being rigidly connected to each C-shaped bracket and the upper finger 66 supported by cylinder rod 68 of second cylinder 69. The open end of each C-shaped bracket 62 faces inwardly along the length of cross bar 46, and the finger clamp assemblies 56 and 58 are each positioned on the cross bar at locations where the grasping fingers 55 and 56 are aligned with the side edge portions of an oncoming sheet 15.

Cylinders 61 and 69 of the finger clamp assemblies 56 and 58 are actuated by photocells 39 and 40. When the photocells detect the oncoming edge of a sheet on the conveyor, the movable support frame 42 is located at the end of the conveyor and the cylinders 69 close the grasping fingers 65 an 66 about the oncoming edge portions of the sheet, so as to grasp the sheet at its opposite side edges, adjacent the leading edge. The cylinders 61 are also energized so as to spread the grasping fingers away from each other across the length of the sheet, so as to stretch and maintain the leading edge portion of the sheet 15 into a substantially flat configuration.

Nip roll 70 is rotatable about a horizontal axis 71 and is supported by the stationary support frame 41 (not shown) just above the path of movement of the leading edge of the sheet 15 into the sheet folder 35. Nip roll 70 is powered by a motor (not shown) which is connected to the zero-max transmission 72 and through connecting drive belt 74. Lever 75 of the transmission is pivotal and functions in a conventional manner to change the output of the belt drive 74 from zero velocity to a predetermined angular velocity. Pneumatic cylinder 76 has its cylinder rod 78 connected to lever 75, so that distension and retraction of rod 78 by cylinder 76 turns lever 75 and functions to cause nip roll 70 to rotate or stop rotation.

Sheet feed plate assembly 79 includes a support bar 80 rigidly mounted at its ends to levers 81. Levers 81 are pivotally supported at 82 to stationary support frame 41 (not shown), so that the support bar pivots about the lower ends of the levers 81. Pneumatic cylinder 84 is mounted on the support frame and its rod 85 is connected to the ends of support bar 80, so as to oscillate support bar 80 as indicated by the double-headed arrow 86. Sheet feed plate 88 extends over the upper surface of support bar 80 and includes one edge portion 87 that is rigidly connected to a surface of support bar 80, while the remainder of the sheet feed plate extends rearwardly from the support bar 80 beneath nip roll 70. Since the support bar 80 is offset forwardly of the nip roll 70, the sheet feed plate 88 is movable in an upward arc toward engagement with the lower surface of nip roll 70 when the support bar 80 is moved to the left by cylinder 84, and when the cylinder 84 allows the support bar 80 to move to the right, the sheet feed plate moves in an arc downwardly away from the lower surface of nip roll 70.

Figure 3:
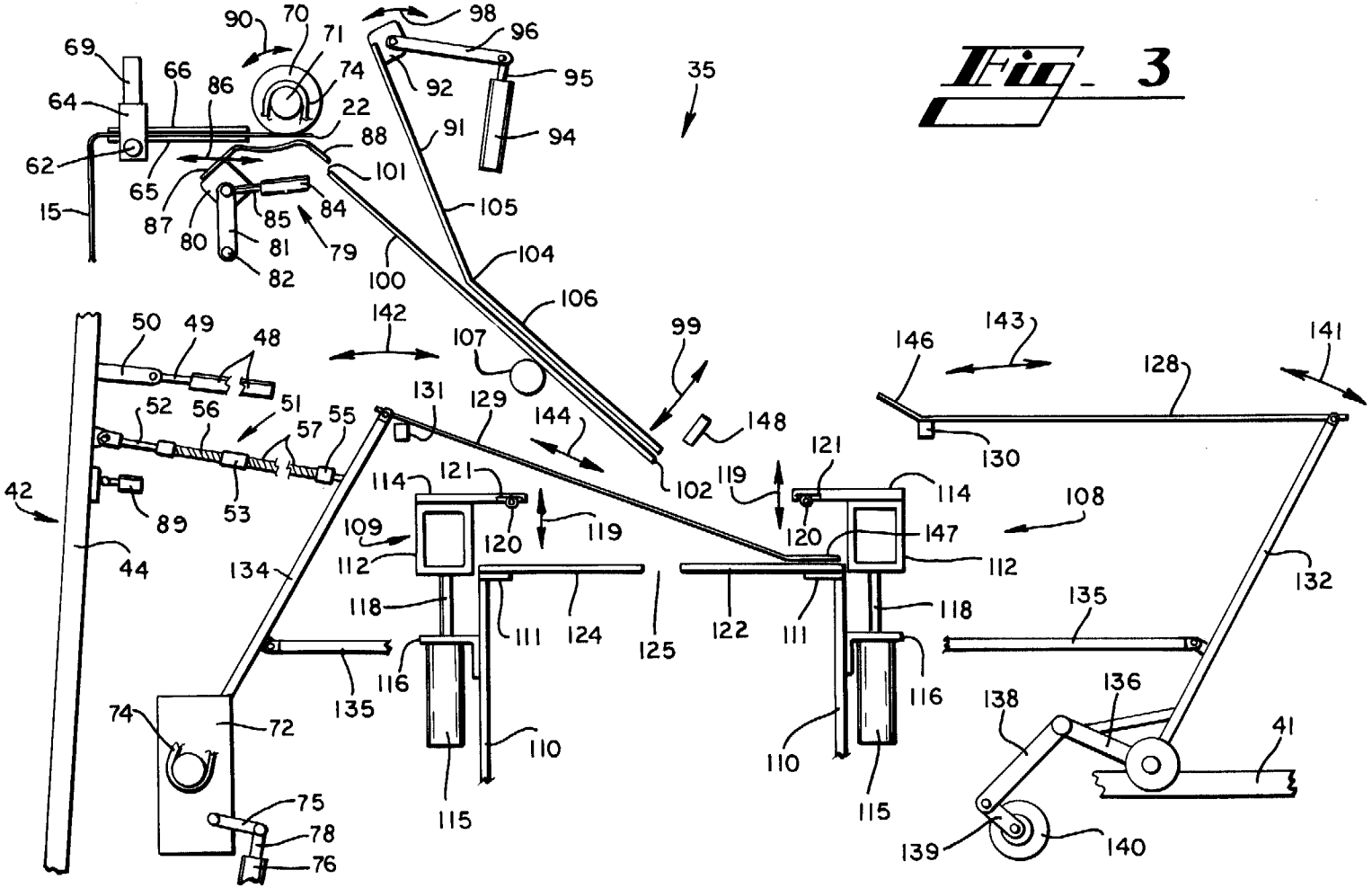
FIG. 3 is a schematic side elevational view of the sheet folder.

As illustrated in FIG. 3, when the movable support frame 42 swings over to sheet folder 35, the grasping fingers 65 and 66 carry the leading edge of the sheet 15 into the space between sheet feed plate 88 and nip roll 70. When the movable support frame 42 reaches this position, a switch 89 is engaged by the movable support frame 42. Switch 89 actuates cylinders 84 at the end of support bar 80 to lift sheet feed plate 88 toward engagements with nip roll 70, to press the leading edge portion 22 of the sheet into frictional engagement with the nip roll. Also, switch 89 actuates pneumatic cylinder 76 which controls the zero-max transmission 72 and begins the rotation of nip roll 70 in the direction indicated by arrow 90, to feed the sheet on into the sheet folder 35. Switch 89 also deactuates cylinders 62 and 69 of the finger clamp assemblies 56 and 58, causing the fingers of each pair of grasping fingers to open. Switch 89 also causes the pairs of grasping fingers to move closer together, and reverses cylinder 48 to return the movable support frame back to the conveyor. Thus, the sheet 15 is now moving under the influence of nip roll 70 and its sheet feed plate 88 on into the sheet folder.

A plurality of pivotal friction plates 91 are positioned adjacent nip roll 70 across the width of the sheet folder 35. Each friction plate is attached at its upper end to friction plate support bar 92, the friction plate support bar 92 being pivotally connected at its opposite ends by the stationary support frame (not shown). Friction plate cylinders 94 are positioned at opposite ends of the friction plate support bar 92 and their cylinder rods 95 are each connected to levers 96. Levers 96 are connected to the ends of the support bar 92, so that when cylinders 94 are actuated they pivot support bar 92 as indicated by the double-headed arrow 98, thus causing the friction plates 91 to move as indicated by double-headed arrows 99.

A downwardly inclined sheet guide plate 100 extends across the width of sheet folder 35 and includes a rectalinear upper edge 101 located beneath sheet feed plate 88 and a rectalinear lower edge 102. The friction plates 91 are creased at 104, so that the upper portion 105 of each friction plate 91 extends at a steeper downward angle from the friction plate support bar 92 and then turns to a more shallow incline at 106 which is parallel to the plane of guide plate 100 when the friction plates 91 rest against the guide plate. A resilient support rod 107 is supported at its ends by the stationary support frame (not shown) and functions to hold guide plate 100 in its proper position and at the same time to permit the friction plates 91 to bounce against guide plate 100 without damaging the guide plate.

A pair of elongated, parallel sheet clamp assemblies 108 and 109 are located beneath guide plate 100. The sheet clamp assemblies 108 and 109 are identical in construction and are arranged with their clamp openings spaced apart and facing each other. The sheet clamp assemblies 108 and 109 each include upright wall section 110, stationary lower clamp element 111 mounted on wall section 110, movable support beam 112, and upper clamp plate 114 mounted on support beam 112. A plurality of pneumatic cylinders 115 are mounted on upright wall section 110 at spaced intervals along the width of the assembly by means of brackets 116, and the cylinder rods 118 are each connected to clamp beams 112. Thus, the clamp beams 112 and the upper clamp plates 114 reciprocate by the action of cylinders 115 as indicated by double-headed arrows 119. A tubular gasket 120 is mounted in an elongated recess 121 extending along the bottom surface of each upper clamp plate 114 at the facing edges of the two clamp plates 114.

Sheet support platforms 122 and 124 are mounted on the stationary lower clamp elements 111 of each sheet clamp assembly 108 and 109 and extend horizontally inwardly from each clamp assembly toward one another in a common plate. A gap 125 is formed between the sheet support platforms 122 and 124, so that the sheet clamp assemblies 108 and 109 can be moved toward or away from each other so that the folds to be made in the sheets can be larger or smaller.

A pair of sheet spreader or fold plates 128 and 129 are located above the sheet clamp assemblies 108 and 109 with the first sheet fold plate 128 being located above the first sheet clamp assembly 108 and the second sheet fold plate 129 being located above the second sheet clamp assembly 109. Fold plate guide bars 130 and 131 are also located above sheet clamp assemblies 108 and 109, and fold plates 128 and 129 rest on and move across guide bars 130 and 131. The outer, upper edges of the fold plates 128 are hingedly connected to the upper ends of fold plate drive levers 132 and 134, and the lower ends of the levers 132 and 134 are pivotally mounted on stationary support frame 41. Connecting rod 135 is connected at its ends to each of fold plate drive levers 132 and 134, causing the levers and their respective fold plates 128 and 129 to move simultaneously. Drive arm 136 is rigidly connected at one of its ends to the lower end of fold plate drive lever 132, connecting arm 138 is connected atone of its ends to the other end of drive arm 136, and crank arm 139 is connected to the other end of connecting arm 138 and to fold plate drive motor 140. Thus, when fold plate drive motor rotates its crank arm 139, fold plate drive levers 132 and 134 oscillate as indicated by double-headed arrows 141 and 142 so as to move fold plates 128 and 129 as indicated by arrows 143 and 144 alternately into and out of the first and second sheet clamp assemblies 108 and 109. The end portions of the fold plates 128 and 129 are angled at 146 and 147 so that when the fold plates are moved into the clamps 108 and 109, the angled edge portions 146 and 147 of each fold plate 128 and 129 will lie parallel to the sheet support platforms 122 and 124.

As progressively illustrated in FIGS. 4A–4G, the accordion section of the sheet folder 35 feeds the leading edge portion 22 of the sheet 15 down the inclined guide plate 100 while the friction plate 91 is lifted away from the guide plate, so that the leading edge portion is free to move and is directed toward first clamp assembly 108. A photocell 148 is located adjacent the lower edge of guide plate 100 and detects the oncoming leading edge 22 of the sheet 15 as it moves toward first clamp assembly 108. After a short time delay after the detection by the photocell 148 which is sufficient to allow the leading edge portion 22 to reach first clamp assembly 108, the pneumatic cylinders 115 of first clamp assembly 108 are energized to move upper clamp plate 114 down into a holding engagement with the leading edge portion 22 of the sheet (FIG. 4B), and friction plates 91 are allowed to drop against guide plate 100. The first fold plate 128 is thrust into the plane of sheet 15 to pull the sheet between the guide plate 100 and friction plates 91 and to spread the sheet away from its leading edge portion 22 and away from first clamp assembly 108 toward second clamp assembly 109 (FIG.

Figure 4A:
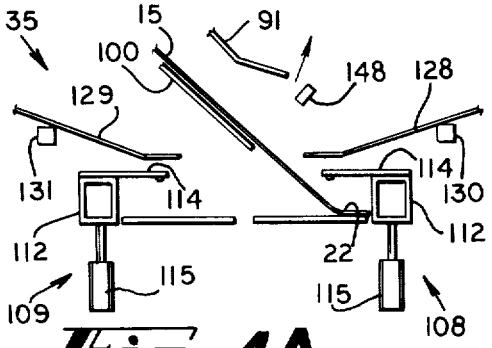
FIGS. 4A, 4B, 4C, 4D, 4E, 4F and 4G are progressive schematic illustrations of the process of folding a sheet into an accordion fold.
Figure 4B:
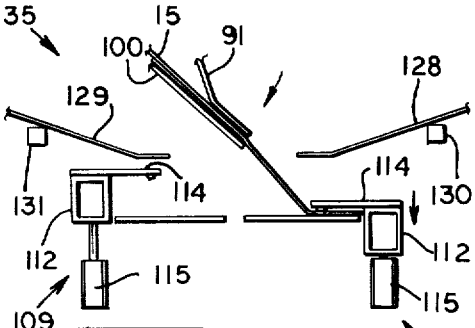
Figure 4C:
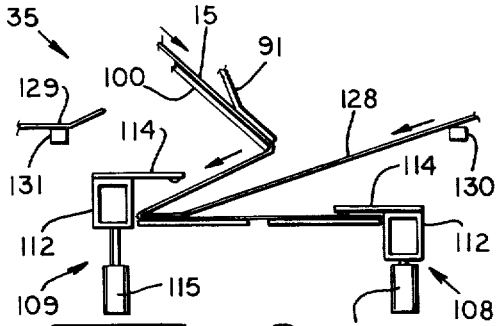
Figure 4D:
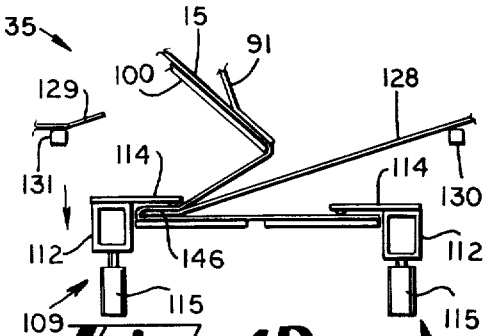
Figure 4E:
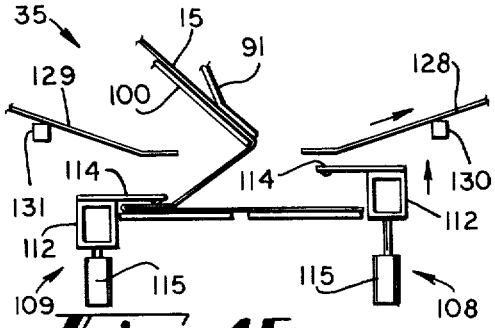
Figure 4F:
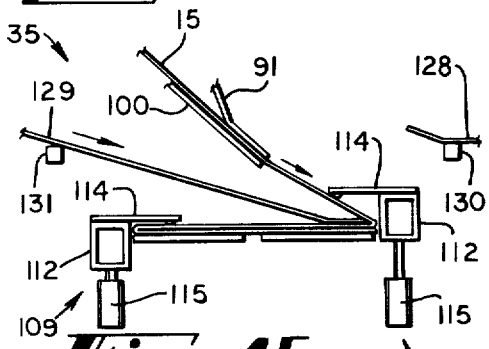
Figure 4G:
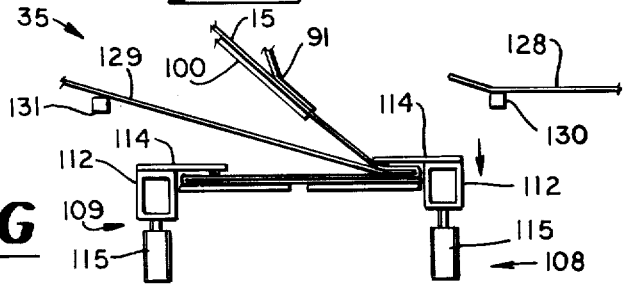

4C). When the first fold plate 128 reaches its distended position, second clamp assembly 109 is retracted by its cylinders 115 into its down, grasping position about the sheet 15 and the flattened end portion 146 of first fold plate 128 (FIG. 4D). The first fold plate 128 is then retracted so as to pull out from second clamp assembly 109 (FIG. 4E) and move about from beneath guide plate 100, and in the meantime, the cylinders 115 of first clamp assembly 108 open the first clamp assembly.

Second fold plate 129 now moves beneath guide plate 100 into the plane of the sheet and on into first clamp assembly 108 (FIG. 4F), spreading the sheet 15 away from the second clamp assembly 109 into the first clamp assembly 108 and pulling the sheet between guide plate 100 and friction plates 91. When second fold plate 129 has been fully inserted into first clamp assembly 108, first clamp assembly 108 is closed by its cylinder 115 (FIG. 4G) downwardly against the sheet 15 and second fold plate 129, thus holding the sheet in the clamp assembly. The second fold plate 129 then retracts from first clamp assembly 108, leaving the sheet held in first clamp assembly 108, and moves out from beneath guide plate 100.

The cycle of operation continues progressively (FIGS. 4B–4G) until the entire length of sheet 15 has been formed in an accordion fold within the first and second clamp assemblies 108 and 109.

Figure 6:
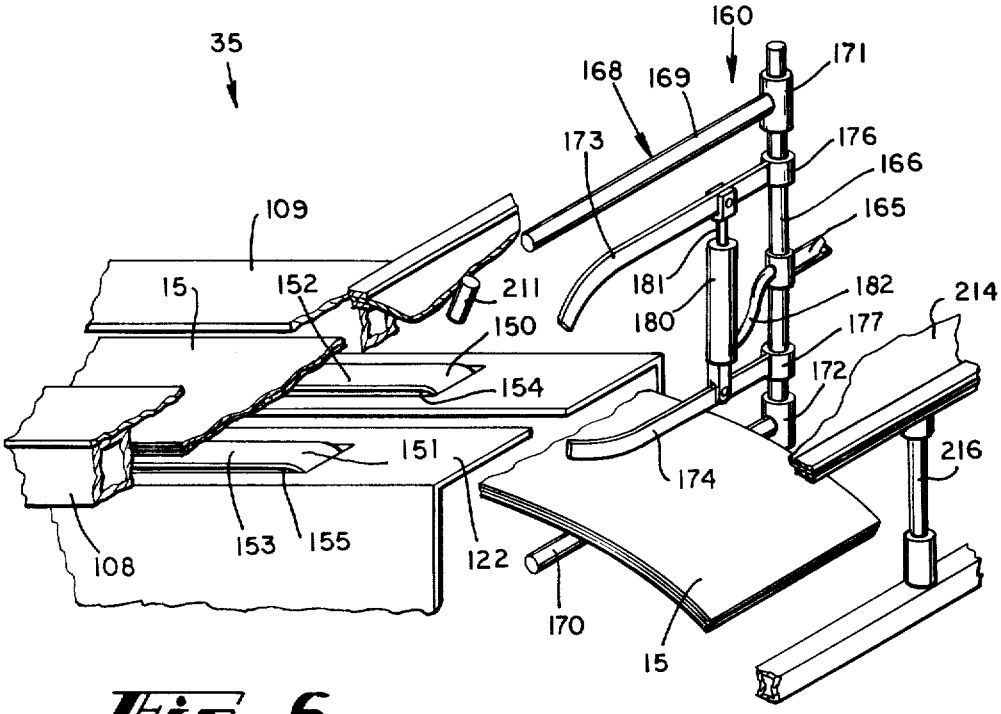
FIG. 6 is a detail perspective illustration of a portion of the winding assembly and an end portion of the accordion folding assembly, with the winding fork oriented in a vertical attitude.

As illustrated in FIG. 6, the accordion fold section of the sheet folder 35 includes belt conveyors 150 and 151 comprising conveyor tapes 152 and 153 extending across the upper surfaces of sheet support platforms 122 and 124 and extending about conveyor rollers 154 and 155 mounted beneath the platforms and driven by a conveyor motor (not shown). When the first and second sheet clamp assemblies 108 and 109 have completed their folding functions and have opened, the belt conveyors 150 and 151 are actuated to convey the accordion folded sheet 15 along the lengths of its folds and along the clamp assemblies 108 and 109, out to the end of the clamp assemblies and on to the winding fork assembly 160.

Figure 5:
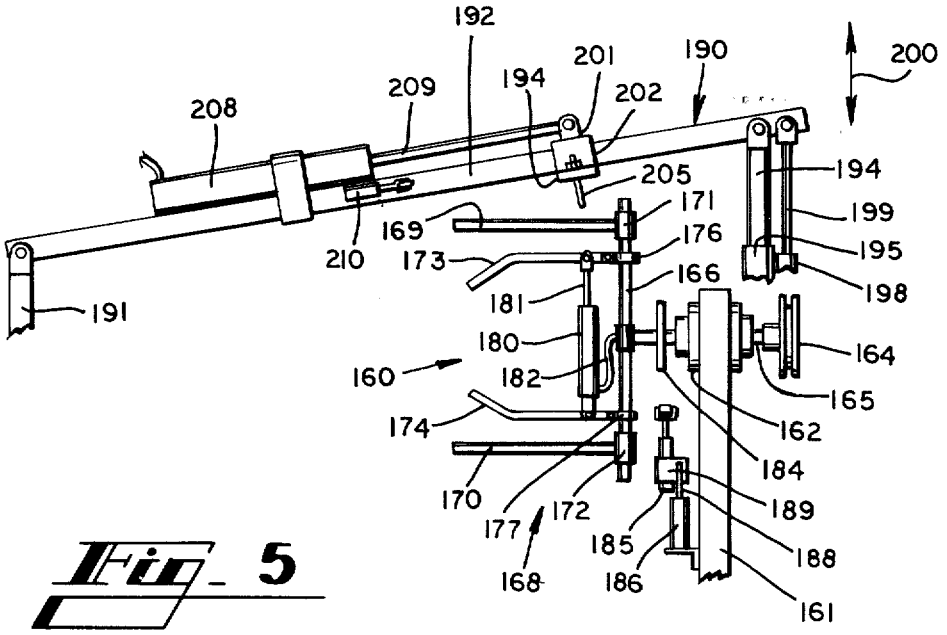
FIG. 5 is a side elevational view of the winding assembly which forms the sheet in a substantially flat spiral folded configuration.

As illustrated in FIGS. 5 and 6, the winding fork assembly comprises an upright support 161, bearing assembly 162 mounted on support 161, drive sheave 164 mounted on tubular axle 165 on one side of support 161, and axle 165 which extends through bearing assembly 162 and which is rigidly connected at its other end to cross bar 166 of winding fork 168. Winding tines 169 and 170 extend parallel to each other and project horizontally from cross bar 166 and are movably supported on cross bar 166 by clamps 171 and 172. Clamp tines 173 and 174 are located intermediate winding tines 169 and 170 and also extend approximately parallel to each other and are pivotally supported on cross bar 166 by clamps 176 and 177. Pneumatic cylinder 180 is pivotally mounted on clamp tine 174 and its cylinder rod 181 is pivotally connected to the other clamp tine 173. Thus, when the rod 181 of cylinder 180 is distended, the clamp tines 173 and 174 are pivoted toward engagement with the winding tines 169 and 170, to grasp the accordion folded sheet 15 between one clamp tine and one winding tine. The air supply to cylinder 180 is carried through conduit 182 which communicates with the opening through tubular axle 165 and to a source of air under pressure (not shown).

A circular cam 184 is rigidly mounted on tubular axle 165, and cam switch 185 is located in the plane of the cam. Pneumatic cylinder 186 supports cam switch 185 on cylinder rod 188 and bracket 189, so that the cam switch 185 is movable toward and away from the path of cam 184 by cylinder 186.

A horse's head support assembly 190 is positioned over winding fork 168 and includes a stationary support stanchion 191, cross head 192 pivotally supported at one of its ends by stanchion 191, guide bar 194 pivotally mounted at its upper end to the other end of cross head 192 and stationary upright guide sleeve 195 which receives guide bar 194. Pneumatic cylinder 198 is mounted on guide sleeve 195 and its rod 199 is connected to cross head 192 and functions to reciprocate cross head 192 as indicated by arrow 200.

Stripping fork 201 is mounted on cross head 192 and includes a bracket 202 slidable along the length of cross head 192, fork support plate 194 connected to bracket 192 and extending beneath and extending laterally from cross head 192, and tines 205 and 206 mounted at their upper ends in fork support plate 204 and extending downwardly therefrom. Pneumatic cylinder 208 is mounted on cross head 192 and its rod 209 controls the movement of stripping fork 201 along the length of cross head 192. Limit switch 210 is also mounted on cross head 192 and is in the path of movement of stripping fork 201, so as to detect the movement of stripping fork 201 at the end of its stroke. A photocell 211 (FIG. 6) is located at the end of the accordion folding section of the sheet folder 35 and detects the oncoming leading end of the accordion folded sheet as the sheet moves into the winding fork assembly 160.

Figure 7:
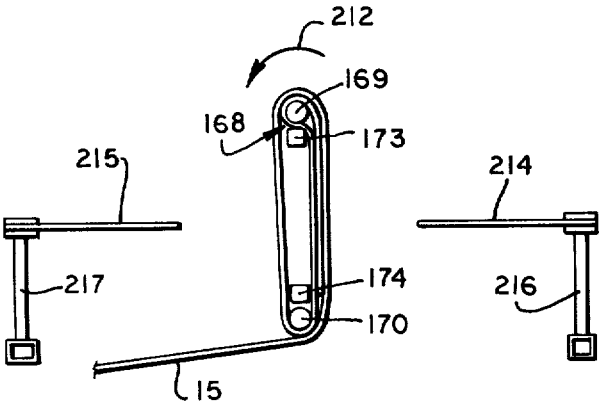
FIG. 7 is a schematic end view of the winding assembly of FIG. 5, with the winding fork rotating through a vertical attitude.

When the photocell 211 detects the oncoming leading end of the accordion folded sheet from the accordion folding section of the sheet folder 35, it actuates the clamp cylinder 180 of the winding fork assembly 160 after a time delay sufficient to allow the leading end of the sheet 15 to move between the lower one of the winding tines 169 or 170 and its adjacent clamp tine 173 or 174. The clamp tines 173 and 174 are then thrust apart toward engagement with the winding tines 169 and 170 by cylinder 180, thereby clamping the leading end portion of the sheet 15 between a winding tine and a clamp tine, and the drive motor (not shown) rotates sheave 164 (FIG. 5) and winding fork assembly 160 in the direction indicated by arrow 212 (FIG. 7) so as to wind the sheet in a substantially flat, spiral folded configuration about the winding tines 169 and 170 of the winding fork 168. After a time delay sufficient to move the leading end portion of the sheet into the winding fork, the conveyor belts 150 and 151 of the accordion fold section of the assembly are deactivated, thereby imparting drag to the trailing portion of the sheet 15 which follows the leading portion onto the winding fork, causing the sheet to become tightly wound about the winding tines 169 and 170. Furthermore, a pair of friction plates 214 and 215 are each supported in a cantilever arrangement on support stanchions 216 and 217 on opposite sides of the winding fork 168, so that the innermost edges of the friction plates 214 and 215 tend to engage the portions of the sheet extending about the winding tines 169 and 170, to further compress the sheet against the winding tines and therefore densely pack the sheet on the winding fork assembly.

Figure 8:
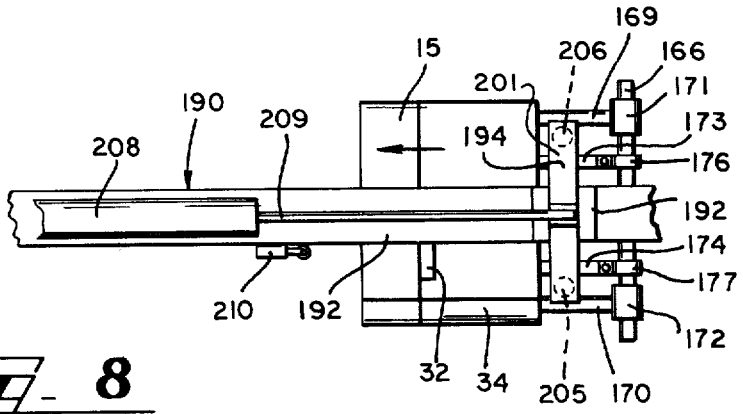
FIG. 8 is a top view of the winding assembly in FIG. 5, with the winding fork oriented in a horizontal attitude.

After the sheet has been wound on the winding fork assembly 160, the rotation of the winding fork is terminated with the winding fork oriented in a horizontal attitude (FIG. 8), and the stripping fork 201 is lowered by the horse's head support assembly 190 so that the tines 205 and 206 of the stripping fork 201 project between the clamp tines 173 and 174 and their respective winding tines 169 and 170. When the stripping fork has had enough time to insert its tines into the winding fork, the cylinder 208 of the stripping fork assembly is actuated to move the stripping fork out through the tines of the winding fork, thus moving the sheet wound on the winding fork off the ends of the tines of the winding fork and onto an awaiting work table, etc. When the stripping fork 201 engages limit switch 210, the horse's head support assembly 190 is raised and the stripping fork is moved back to its original position above winding fork assembly 160. Also, cylinder 186 is actuated by limit switch 210, moving cam switch 185 up so that its switch element is in the path of the cam 184, and the motor that drives the winding fork assembly 160 is also energized by limit switch 210. The winding fork 168 therefore begins to rotate away from its horizontal attitude, and when it has rotated 90°, a projection on cam 184 actuates cam switch 185, terminating further rotation of the winding fork assembly, leaving the winding fork assembly in a vertical orientation (FIGS. 5 & 6), ready for receiving another sheet from the accordion folding section of the sheet folder 35.

Figure 9:
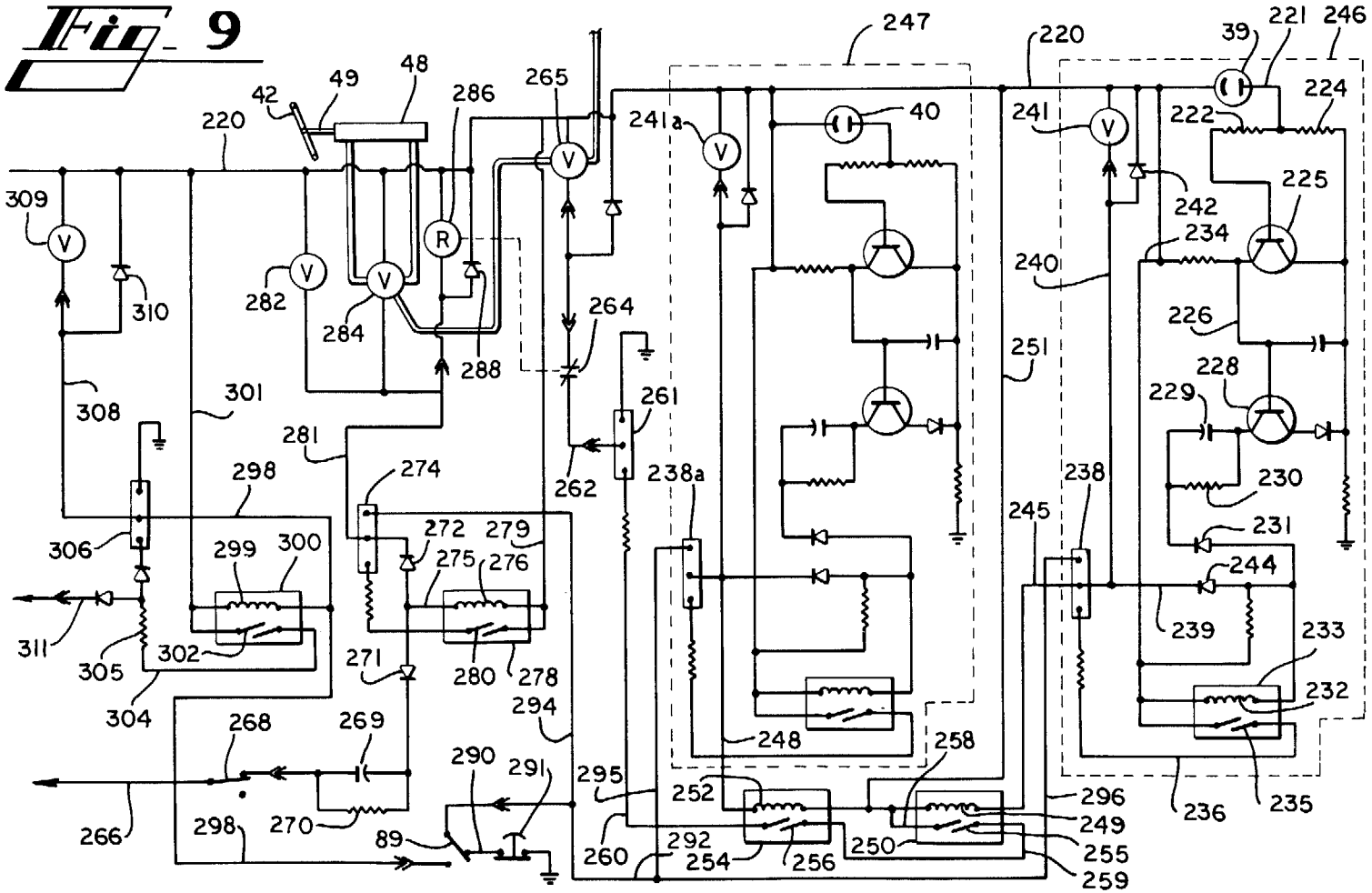
FIG. 9 is an electrical schematic of the infeed section of the accordion folding portion of the sheet folder.

As illustrated in FIG. 9, the control of the mechanical infeed elements of the accordion folding section of the sheet folder 35 comprises photocells 39 and 40 which are located at the end of the conveyor and which initiate the feeding of the sheet from the conveyor to the sheet folder 35. The circuits for photocells 39 and 40 are substantially the same and each includes a positive conductor 220 to which the photocell is connected. Photocell 39 is connected through conductor 221 to biasing resistors 222 and 224, with biasing resistor 222 connected to the base of first transistor 225, and the output of transistor 225 goes through conductor 226 to the base of second transistor 228. The output of transistor 228 is connected to capacitor 229 and resistance 230 in parallel, and then to diode 231 and to the coil 232 of relay switch 233. The coil 232 is connected through conductor 234 to positive conductor 220. Conductor 234 also is connected through the contacts 235 of relay 233, and the contacts are connected through conductor 236 to the base of transistor 238. The output from transistor 238 extends to the right through conductor 239 and conductor 240 to air control valve 241 and also in parallel through diode 242 to the positive conductor 220. Air control valve 241 is thus actuated to close the finger clamp of finger clamp assembly 58 (FIG. 2) by charging the cylinder 69 and closing the fingers 65 and 66 about the leading edge portion of the sheet 15. The conductor 239 from the output of transistor 238 also extends through diode 244 and is connected in a holding circuit back through the coil 232 of relay 233. Thus, the output from transistor 238 will be maintained and air control valve 241 will remain in its shifted position without a further signal from photocell 39. The output from transistor 238 also extends through conductor 245 to the left of the diagram. Thus, the circuitry illustrated within the dashed lines 246 comprises the first photocell circuit. A similar second photocell circuit is illustrated inside the dashed lines 247. Thus, both photocell circuits 246 and 247 are initially actuated in response to the photocells 39 and 40 seeing the oncoming edge of the sheet 15, and these circuits are latched on and provide an output through conductors 245 and 243.

The signal from conductor 245 is directed to the coil 249 of relay 250 and then through conductor 251 to the positive conductor 220. The output from conductor 248 is conducted through the coil 252 of relay 254 and then through conductor 251 to the positive conductor 220. Thus, both contacts 255 and 256 of relays 250 and 254 are closed. This permits a positive signal from conductors 220, 251, 258, through contacts 255, conductor 259, contacts 256, and then through conductor 260 to the base of transistor 261. The output 262 from transistor 261 then passes through normally closed relay contacts 264 to arm travel lock-out valve 265 which cuts off the air pressure to movable support frame cylinder 48 (FIGS. 2 and 3), thus allowing the springs of spring assembly 51 to move the movable support frame 42 away from the conveyor to an intermediate position between the conveyor and the sheet folder 35.

One of the sewing heads 18 or 19 (FIG. 1) of the conveyor has the circuit to its motor connected to conductor 266 (FIG. 9), through on-off switch 268, in parallel through capacitor 269 and resistance 270, through diode 271, diode 272, to the output of transistor 274. A circuit is also made through conductor 275 through the coil 276 of relay 278, and through conductor 279 to the positive conductor 220. This closes the contacts 280 of relay 278, putting a positive bias on the base of transistor 274, causing a signal to be emitted from the output of transistor 274 through conductor 281 to finger stretch valve 282, arm travel valve 284, the coil of control relay 286, and diode 288. The coil of control relay 286 then opens the normally closed contacts 264, thus shifting arm travel lock-out valve 265 back to its original position, where air under pressure can communicate in series first through arm travel lockout valve 265 and then through arm travel valve 284 to movable support frame cylidner 48. The actuation of arm travel valve 284 directs the air to the other side of cylinder 48 causing the movable support frame to move from its neutral position over the sheet folder. In the meantime, finger stretch valve 282 charges cylinders 61 of finger clamp assemblies 56 and 58, thereby causing the leading edge of the sheet to be stretched as it is moved into the nip roll of a sheet folder.

As the movable support frame 42 moves on into the sheet folder, the support frame enages limit switch 89 (FIGS. 2, 3 and 9). Switch 89 in its normally closed position is connected to ground through conductor 290 and reset switch 291 and is connected to the emitter of arm travel transistor 274 through conductor 294, is connected to the emitter of No. 2 finger clamp output transistor **238*a* through conductors 292 and 295, and is connected to the emitter of No. 1 finger clamp output transistor 238 through conductors 292 and 296. When limit switch 89 is opened, the negative contact to the emitters of transistors 274, 238*a* and 238 is lost, which results in the signal being lost from each of the three transistors and killing the signal from photocell circuits 246 and 248 and from the arm travel transistor 274. Thus, arm travel valve 284 shifts back to its original position, causing movable support frame 42 to shift away from the sheet folder back to its waiting position adjacent the conveyor (FIGS. 2 & 3), the finger stretch valve 282 is shifted so that the finger clamp assemblies 56 and 58 move toward each other, the coil of control relay 286 allows its contacts 264 to close which would normally shift arm travel lock-out valve 265 so as to cut off the flow of air to cylinder 48, but the signal to the base of transistor 261 is also lost because of the opening of the contacts 255 and 256 of relays 250 and 254 and no signal passes to arm travel lockout valve 265. Thus, air pressure still communicates through arm travel lock-out valve 265 and arm travel valve 284 to move the movable support frame back to its ready position at the conveyor. Also, finger clamp valves 241 and 241a in photocell circuits 246 and 248 are shifted so that the grasping fingers 65 and 66 of each finger clamp assembly 56 and 58 open and release the leading edge of the sheet material which is now at the nip roll 70**.

Figure 10:
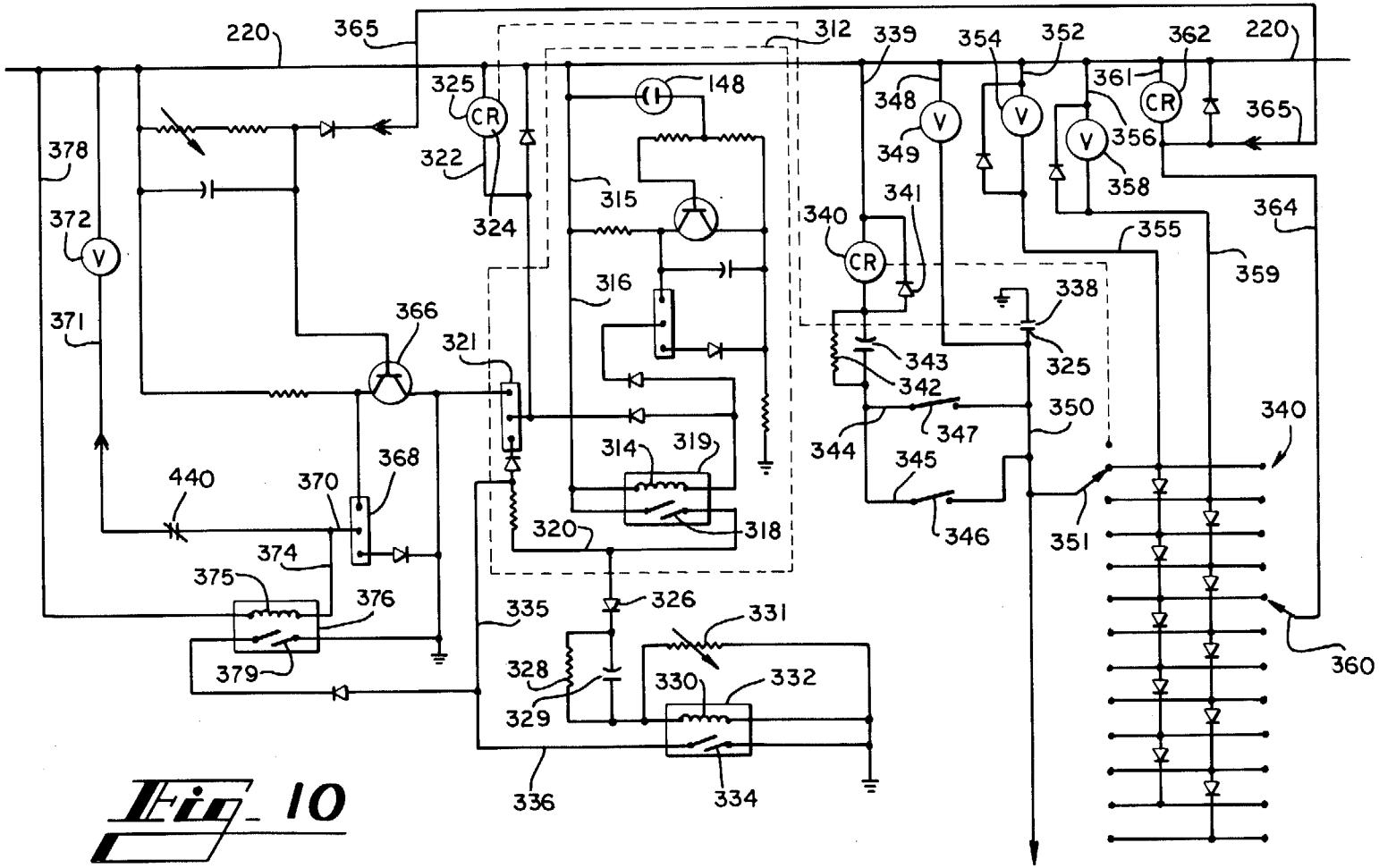
FIG. 10 is an electrical schematic of the accordion folding section of the sheet folder.

When limit switch 89 (FIG. 9) is shifted by contact from the movable support frame 42, it makes a circuit through conductor 298 through the coil 299 of relay 300, and then through conductor 301 to the positive conductor 220. This closes the contacts 302 of the relay 300 and makes a circuit from positive conductor 220 through conductor 301, relay contacts 302, conductor 304, resistor 305 to the base of transistor 306. Conductor 298 is also connected to the output of transistor 306, so that a circuit is made through conductor 308 to air control valve 309 to positive conductor 220 and also in parallel through diode 310 to conductor 220. Thus, a holding circuit is made through conductor 311, conductor 304, contacts 302 and the coil 299 of relay 300, conductor 298 through transistor 306, control valve 309 to positive contact 220. Conductor 311 is connected to conductor 350 (FIG. 10) through the contacts 338 of control relay 325, to ground. Thus, when switch 89 is opened from conductor 298 and moved back to conductor 292, the output from transistor 306 will continue and valve 309 will remain in its shifted position. Valve 309 causes cylinder 76 of the zero-max transmission 72 to shift, causing an output to be generated from the transmission, thereby causing the nip roll to begin its rotation. Also, valve 309 shifts cylinder 84 so as to raise the sheet feed plate 88 up against the nip roll 70, thereby urging the leading edge of the sheet against the nip roll and causing the sheet to be fed on into the sheet folder. Also, valve 309 actuates friction plate cylinder 94, causing the friction plates 91 to be lifted away from the guide plate 100, and allowing the leading edge of the sheet to move down the guide plate 100 into the first clamp assembly 108.

When the leading edge of the sheet moves down the sheet guide 100 toward the first clamp assembly 108, it passes photocell 148 (FIGS. 2, 3 and 10) and then moves on into the first clamp assembly. The photocell 148 is in a photoelectric cell circuit 312 (FIG. 10) which is similar to the photoelectric cell circuits 246 and 248 of FIG. 9, and its latch relay 319 makes a circuit from positive conductor 220 through conductors 315, 316, the contacts 318 of the relay 319, contact 320 to the base of transistor 321. The output of transistor 321 creates a holding circuit back through the coil 314 of relay 319 and also creates a circuit through conductor 322 and the coil 324 of the control relay 325. Also, an on-delay circuit is made from relay 319 through its conductor 320, diode 326, in parallel through resistance 328 and capacitor 329, then in parallel through relay coil 330 and variable potentiometer 331, to ground. The setting of the variable potentiometer 331 varies the time delay in which the coil 330 of relay 332 closes its contacts 334. When the contacts 334 are closed, the input through conductor 320 to transistor 321 is grounded through conductors 335, 336, through contacts 334 of relay 332, to ground. This terminates a signal from transistor 321 and opens a circuit made to the coil 324 of control relay 325. In the meantime, the normally open contacts 338 of control relay 325 are closed.

The closed contacts 338 of the control relay 325 make a circuit from positive conductor 220 through conductor 339, in parallel through stepping relay 340 and diode 341, in parallel through resistance 342 and capacitor 343, and in parallel through conductors 344 and 345 and their limit switches 346 and 347. Also, a circuit is made from positive conductor 220 through conductor 348, the pilot valve 349 of fold plate drive motor 140, to conductor 350 to ground through the contacts 338 of control relay 325. This causes the fold plates 128 and 129 to begin their oscillation into and out of the first and second clamp assemblies 108 and 109 (FIG. 3). Limit switches 346 and 347 are located on the drive shaft of the fold plate drive motor 140, so that limit switch 346 closes momentarily when the second fold plate 129 is received in the first clamp assembly 108 and limit switch 347 is momentarily closed when first fold plate 128 is received in second clamp assembly 109.

When limit switch 346 is closed, a circuit is made through the coil of stepping relay 340. This causes the movable arm 351 of stepping relay to move one position to the next contact. When limit switch 346 is opened and limit switch 347 is closed, another circuit is made to the coil of the stepping relay 340, so as to move the movable arm 351 to the next position.

When movable arm 351 is in contact with the number one conductor, a circuit is made from the positive conductor 220 through conductor 352, pilot valve 354, conductor 355, through the first position conductor, through the movable arm 351, to ground. Pilot valve 354 actuates the several cylinders 115 on the first clamp assembly 108, causing the first clamp assembly to close. When the first limit switch 346 opens and the second limit switch 347 closes, the stepping relay will move its arm 351 to the next position at contact number two, whereupon a circuit is made from positive conductor 320 through conductor 356, pilot valve 358, conductor 359 to the second position conductor through the movable arm 351 to ground. Pilot valve 358 thus causes its cylinders 115 of the second clamp assembly 109 to close the second clamp assembly. In the meantime, since the circuit has been opened to the first pilot valve 354, the first clamp assembly will have opened.

The continued alternate closing of the limit switches 346 and 347 causes the movable arm 351 of the stepping relay to continue to move across its contacts and alternately close each of the clamp assemblies until the stepping switch arm 351 reaches the contact of the switch which is made with the count arm 360, whereupon a circuit is made from the positive conductor 220 through conductor 361, through the reset coil of the reset relay 362, through conductor 364, count arm 360, through the lattice of conductors to the movable arm 351, to ground, whereupon the movable arm 351 is set back to its zero position. This terminates the procedure of alternately clamping the opposite sides of the accordion folded sheet.

When the stepping switch arm 351 momentarily made a circuit with the coil of the reset relay 362, a circuit is also made through conductor 365 to transistor 366, the output of which is connected to transistor 368, and transistors 368 provides an output through conductor 370 through normally-closed relay contact 440, through conductor 371 and through conveyor belt pilot valve 372. This causes the conveyor belts 151 and 152 (FIG. 6) to begin their operation to move the accordion folded sheet toward the winding fork 168. In the meantime, a circuit is made from transistor 368 through conductors 370 and 374 through the coil 375 of relay 376, through conductor 378 to positive conductor 220, causing the contacts 379 of the relay 376 to close. This applies a ground to the conductor 320 leading to transistor 321, thereby terminating the signal through control relay 325 and opening the contacts 338 of the relay. The opening of the contacts of relay 325 therefore opens the entire circuit of the stepping relay 340 to prevent the stepping relay arm 351 from resuming its movements until the photocell 148 detects another oncoming sheet.

Figure 11:
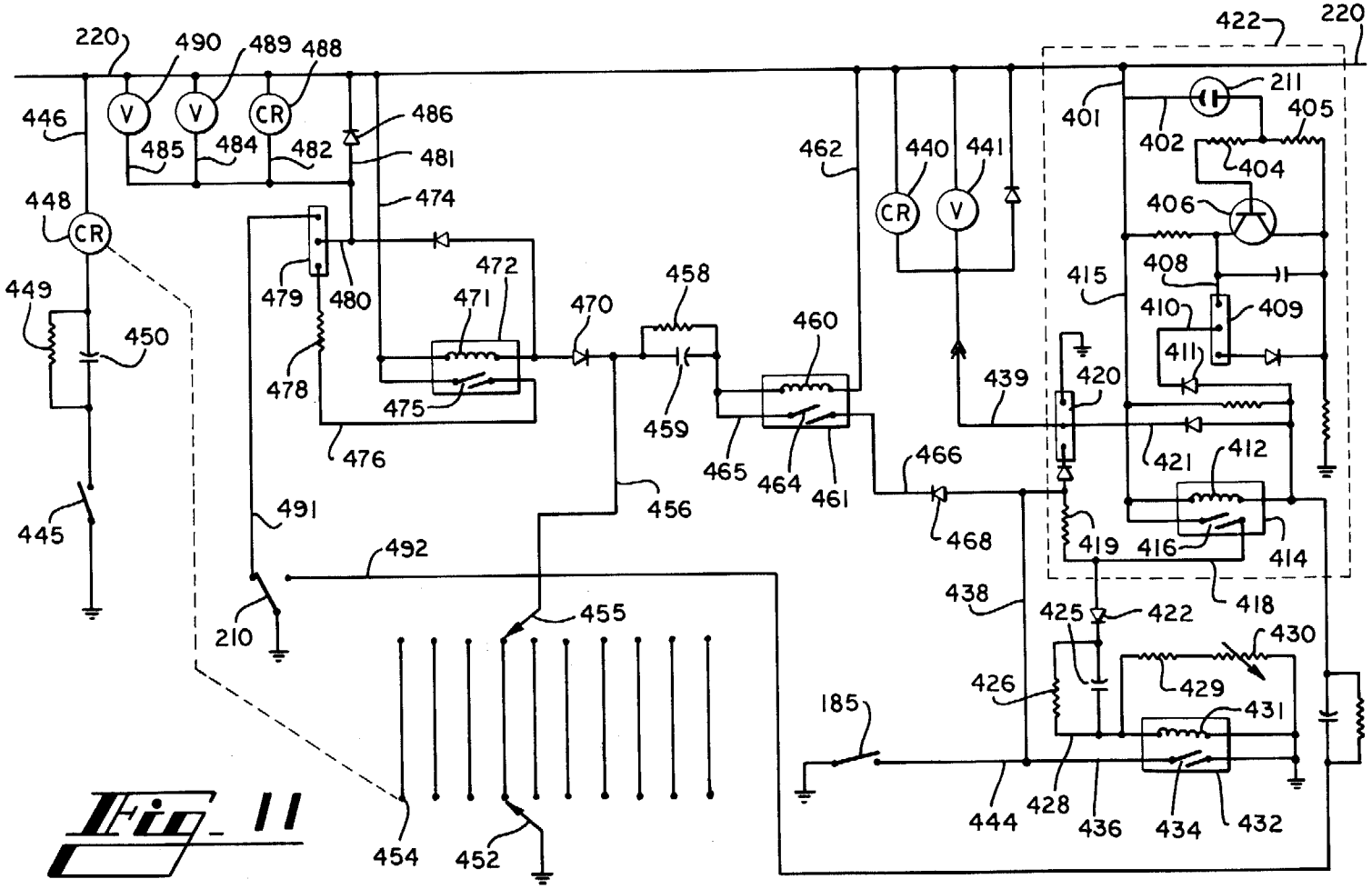
FIG. 11 is an electrical schematic of the winding fork assembly section of the sheet folder.

When the sheet has been accordion or pleat folded, the belt conveyors 151 and 152 move the sheet along the length of the accordion folding device toward the winding fork assembly 160 (FIG. 6), and photocell 211 detects the oncoming leading edge of the accordion folded sheet. As illustrated in FIG. 11, photocell 211 makes a circuit from positive conductor 220 through conductors 401 and 402 to biasing resistors 404 and 405, to the base of transistor 406. The output from transistor 406 is connected through conductor 408 to the base of transistor 409, and the output of transistor 409 is connected through conductor 410 and a diode 411 to the coil 412 of latch relay 414 then back through conductors 415 and 401 to positive 220. This closes the contacts 416 of relay 414, making a circuit from positive conductor 220, conductors 401, 415, contacts 416, conductor 418, resistor 419, to the base of transistor 420. The signal from transistor 420 is conducted through conductor 421 to the coil 412 of relay 414 to form a holding circuit. Thus, the circuitry within the dash lines 422 functions as a third photoelectric cell circuit, similar to those circuits indicated at 246 and 248 of FIG. 9.

Conductor 422 receives the signal from conductor 418, the signal passes through diode 424, in parallel through capacitor 425 and resistance 426, through conductor 428, the signal is then split and passes in series through resistance 429 and variable resistance 430 to ground, and the other part of the signal passes through the coil 431 of delay-on relay 432 to ground. This circuit is a time delay circuit, and the delay is controlled by the variable resistance 430. After the desired delay has occurred, the coil 431 closes the contacts 434 of relay 432, causing the ground circuit to be made through conductors 436 and 438 to conductor 418, between the resistance 419 and transistor 420. This eliminates the signal the base of transistor 420. Thus, while the photocell circuit 422 initially provides an output through conductor 439 to the coil of conveyor belt relay 440 and the coil of wind-up clutch solenoid 441, the delay-on circuit eliminates the signal after the desired time delay, stopping the conveyor belt and making the wind-up clutch. Thus, the oncoming leading edge of the sheet has been seen by the photocell and the conveyor continues to operate for a predetermined time delay so that the oncoming end of the sheet is moved into the winding fork, whereupon the conveyor action is terminated and the wind-up clutch is made.

After the wind-up clutch has been made, the winding fork beings its rotation and its cam (84 (FIG. 5) and closes cam switch 445 for each one-half rotation of the winding fork. The repeated closing of cam switch 445 makes and breaks a circuit from positive conductor 220, through conductor 446, stepping coil 448, in parallel through resistor 449 and capacitor 450, and through conductor 451. The stepping coil 448 of the stepping relay is connected to the movable arm 452 and intermittently shifts the arm 452 across the contacts 454 of the stepping relay in response to each closing of cam switch 445. When the stepping arm 452 is aligned with indicator arm 455, a circuit is made from ground through conductor 456, then in parallel through resistance 458 and capacitor 459, through the coil 460 of stop relay 461, and through conductor 462 to the positive conductor 220. Relay coil 460 then closes contacts 464 and a signal is made through stepping switch contact 455, conductor 466, conductor 465, relay contacts 464, conductor 456, diode 468, to conductor 418, thus grounding the signal made to transistor 420. Transistor 420 thereby loses its output through conductor 439, so that the valve 441 of the wind-up clutch is opened so that the wind-up clutch no longer drives the winding fork, and the coil 440 of the relay switch to the conveyor drive system would ordinarily permit the conveyor to resume its function. Cam switch 445, having been opened on every 180° rotation of the winding fork, causes the winding fork to be stopped in a horizontal attitude.

The ground signal from stepping switch 452–455 also is transmitted through conductor 456 through diode 470, the coil 471 of latch relay 472, through conductor 474 to positive conductor 220. This causes the contacts 475 of relay 471 to close, sending a positive signal through conductor 474, contacts 475, conductor 476, resistance 478 to the base of transistor 479. The output of transistor 479 sends a signal to conductor 480 which forms a holding circuit through coil 471 of latch relay 427 and which also sends a signal to conductors 481, 482, 484 and 485, through diode 486, reset coil 488 of stepping relay 452–455, valve 489 which operates cylinder 198 of stripping fork 201 (FIG. 5) and valve 490 which operates cylinder 208 of stripping fork 201. The reset coil 488 of the stepping relay shifts the movable arm 452 back to its zero position and breaks the circuit made from the stepping relay. Also, valve 489 causes the stripping fork 201 to move down into the winding fork while valve 490, after a pneumatic time delay, causes cylinder 208 to pull the stripping fork 201 through the winding fork and to strip the sheet from the winding fork.

When the stripping fork reaches the end of its stroke, it engages the limit switch 210 (FIGS. 5, 8 and 11), shifting the switch away from conductor 491 over to conductor 492. Since conductor 491 connects the ground to the emitter of transistor 480, the signal from transistor 480 is lost, which deactivates the reset coil 488, valve 489 which activates the cylinder 198 that pulls the stripping fork down, thereby causing the stripping fork to be raised, and deactivates valve 490 which causes the stripping fork to be moved through the winding fork, thereby urging the stripping fork back to its ready position.

When limit switch 210 makes contact with conductor 492, a circuit is made from ground through conductor 492 through latch relay 414, conductors 415 and 401 to positive conductor 220, causing the contacts 416 of the relay 414 to be closed again. This causes transistor 420 to send an output signal through conductor 439 to the valve 441 of the wind-up clutch of the winding fork, causing the winding fork to begin rotation again. However, when the valve 489 was shifted by the shifting of limit switch 210 to raise the stripping fork, valve 489 also actuated switch cylinder 186 (FIG. 5) to lift switch 185 up toward the path of the cam 184 of the winding fork. When the winding fork rotates approximately 90°, its cam will close switch 185, which, in series with closed switch 442, grounds the signal to transistor 420, therefore terminating the signal to wind-up clutch valve 441 and terminating the rotation of the wind-up fork. This leaves the wind-up fork in a vertical attitude, ready for receiving another accordion folded sheet in the manner illustrated in FIG. 6.

While this invention has been described in detail with particular reference to a preferred embodiment thereof, it will be understood that variations and modifications can be effected within the spirit and scope of the invention as described hereinbefore and as defined in the appended claims.

What is claimed is:

1. A method of folding rectangular bed sheets and the like comprising moving a sheet in a substantially unfolded configuration along its length along a horizontal path, grasping the sheet at the sides of its leading edge, pulling the sheet at its leading edge across its length to stretch the leading edge of the sheet, moving the stretched leading edge of the sheet into a nip roll means for grasping the leading edge portion of the sheet, and feeding the leading edge of the sheet with the nip roll means down an incline toward a first clamp means, and when the leading edge of the sheet arrives at the first clamp means, releasing the sheet with the nip roll means and holding the leading edge of the sheet in the first clamp means, spreading the sheet away from the first clamp means into a second clamp means, holding the sheet in the second clamp menas and releasing the sheet with the first clamp means, spreading the sheet away from the second clamp means into the first clamp means, repeating the steps of holding, spreading and releasing until the sheet is formed in a flat elongated accordion fold, moving the accordion folded sheet laterally along its folded length and progressively folding the sheet across its accordion folds in an approximately flat spiral fold.

2. The method of claim 1 and wherein the steps of alternately spreading the sheet away from the first and second clamp means comprises thrusting a first plate into the sheet and into the second clamp means from a position adjacent the first clamp means and withdrawing the first plate from the second clamp means, and thrusting a second plate into the sheet and into the first clamp means from a position adjacent the second clamp means and withdrawing the second plate from the first clamp means, and wherein the steps of holding the sheet in the first and second clamp means comprises holding the sheet with the first or second clamp means as the second or first plate withdraws from the first or second clamp means respectively.

3. The method of claim 1 and further including the step of applying drag friction to the sheet as the sheet moves into its accordion folded configuration.

4. The method of claim 1 and further including the step of accumulating a loose length of the sheet between the steps of grasping the sheet and moving the leading edge of the sheet into a nip roll.

5. A method of folding a rectangular bed sheet or the like comprising smoothing the sheet adjacent an edge portion thereof, and while the edge portion of sheet is smooth moving the smoothed edge portion into a sheet folder, and as the sheet moves into the sheet folder progressively folding the sheet in a flat elongated accordion folded configuration, moving the accordion folded sheet along the direction if its accordion folds, and progressively folding the accordion folded sheet in a substantially flat spiral folded configuration as it moves in the direction of its accordion folds.

6. A method of folding sheet material comprising moving one edge portion of the sheet into a first clamp, holding the edge portion in the sheet in the first clamp, spreading the sheet away from the first clamp into a second clamp, holding the sheet with the second clamp and releasing the sheet with the first clamp, spreading the sheet away from the second clamp into the first clamp, holding the sheet with the first clamp and releasing the sheet with the second clamp, and repeating the holding, spreading and releasing steps until the sheet is formed in a flat accordion folded configuration, moving the sheet in its accordion folded configuration along the lengths of its folds, and winding the sheet into an approximately flat spiral folded configuration.

7. The method of claim 6 and further including the step of applying drag to the sheet during the spreading steps.

8. The method of claim 6 and wherein in steps of spreading the sheet into the second clamp comprises thrusting a first fold plate from adjacent the first clamp into the plane of the sheet and into the second clamp, and wherein the step of spreading the sheet into the first clamp comprises thrusting a second fold plate from adjacent the second clamp into the plane of the sheet and into the first clamp.

9. A method of folding a bed sheet or the like comprising moving an unfolded sheet along its length in a downward direction from above a first and a second clamp means until the leading edge of the sheet moves into the first clamp means, holding the leading edge of the sheet in the first clamp means, moving a first fold element from above the first clamp means laterally into the plane of the sheet and into the second clamp means, holding the sheet in the second clamp means and releasing the sheet with the first clamp means, withdrawing the first fold element from the second clamp means, moving a second fold element from above the second clamp means laterally into the plane of the sheet and into the first clamp means, holding the sheet in the first clamp means and releasing the sheet with the second clamp means, withdrawing the second fold element from the first clamp means, and repeating the movements of the fold elements and holding and realeasing of the sheet until the sheet is formed in an accordion folded configuration, moving the sheet in its accordion folded configuration along the lengths of its folds, and winding the sheet into an approximately flat spiral folded configuration.

10. The method of claim 9 and wherein the steps of moving one fold element into the sheet and withdrawing the other fold element from a clamp means are performed substantially simultaneously.

11. The method of claim 9 and wherein the steps of initiating the holding the sheet with one clamp means and releasing the sheet with the other clamp means are performed substantially simultaneously.

12. A method of folding a bed sheet or the like comprising moving the sheet in an unfolded configuration along its length, progressively folding the sheet in an accordion folded configuration as the sheet moves along its length, moving the accordion folded sheet along the lengths of its folds, grasping the sheet behind its leading end between the tines of a multiple tine winding fork, rotating the fork so that its tines move in concentric circular paths and the sheet winds about the tines of the fork.

13. The method of claim 12 and further including stopping the rotation of the winding fork with the tines of the fork oriented horizontally, and pulling the folded sheet off the ends of the tines of the fork.

14. The method of claim 12 and further including the steps of applying friction to the sheet as it is being wound onto the winding fork to pull the sheet tightly about the winding fork.

* * * * *